US011056296B2

(12) United States Patent
Leusenkamp et al.

(10) Patent No.: US 11,056,296 B2
(45) Date of Patent: Jul. 6, 2021

(54) CIRCUIT BREAKER USING MULTIPLE CONNECTORS

(71) Applicant: Eaton Intelligent Power Limited, Dublin (IE)

(72) Inventors: Martin Bernardus Johannes Leusenkamp, Jiangsu (CN); Xin Zhou, Wexford, PA (US); Anthony Thomas Ricciuti, Bethel Park, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/689,169

(22) Filed: Nov. 20, 2019

(65) Prior Publication Data

US 2021/0151268 A1 May 20, 2021

(51) Int. Cl.
*H01H 33/12* (2006.01)
*H01H 33/42* (2006.01)

(52) U.S. Cl.
CPC ..... *H01H 33/125* (2013.01); *H01H 33/42* (2013.01)

(58) Field of Classification Search
CPC .. H01H 33/125; H01H 33/124; H01H 33/126; H01H 33/127; H01H 33/128; H01H 33/42; H01H 33/6643; H01H 33/6661; H01H 33/6641; H01H 33/6642; H01H 33/122
USPC ..... 218/10, 3–9, 42, 140, 120, 118; 200/15, 200/16 F, 6 C, 254, 16 E, 51.04, 50.11
See application file for complete search history.

(56) References Cited

U.S. PATENT DOCUMENTS 2,480,622 A * 8/1949 Warnock ..... H01H 33/126 218/12
4,072,392 A * 2/1978 McConnell ..... H01H 1/385 439/851
5,013,876 A * 5/1991 Chabala ..... H01H 1/42 200/254

(Continued)

FOREIGN PATENT DOCUMENTS

EP 2465125 B1 6/2012
WO 2012142739 A1 10/2012

OTHER PUBLICATIONS

Zanetti, A. et al., "Current Carrying Capacity of an Earthing Switch for a Generator Circuit Breaker", IEEE Holm Conference on Electrical Contacts, 2018.

*Primary Examiner* — William A Bolton
(74) *Attorney, Agent, or Firm* — Fox Rothschild LLP

(57) ABSTRACT

A circuit breaker having a movable tulip contact and a vacuum interrupter together connecting a first terminal to a second terminal of the circuit breaker. The tulip contact has a first end having contact fingers removably attached to a stationary contact of the first terminal, and a second end that is electrically connected to the second terminal. The vacuum interrupter has a first electrode assembly that is electrically connected to the first terminal, and a second electrode assembly that is electrically connected to the second terminal. The tulip contact and stationary contact provide a first conductive path from the first terminal to the second terminal when the tulip contact is connected to the stationary contact. The vacuum interrupter provides a second conductive path from the first terminal to the second terminal when the vacuum interrupter is in a closed position.

33 Claims, 9 Drawing Sheets

(56) References Cited

U.S. PATENT DOCUMENTS

| | | | | |
|---|---|---|---|---|
| 5,486,662 | A * | 1/1996 | Takiishi | H01H 1/5822 200/50.27 |
| 5,852,266 | A * | 12/1998 | Komuro | C22C 26/00 218/119 |
| 6,437,274 | B2 * | 8/2002 | Claessens | H01H 33/143 218/3 |
| 6,593,538 | B2 * | 7/2003 | Perret | H01H 33/143 218/3 |
| 8,269,127 | B2 | 9/2012 | Seo | |
| 8,581,135 | B2 * | 11/2013 | Piccoz | H01H 33/126 218/120 |
| 2006/0091112 | A1 * | 5/2006 | Neveu | H01H 33/143 218/7 |

* cited by examiner

CIRCUIT BREAKER USING MULTIPLE CONNECTORS

BACKGROUND

This patent document relates to circuit breakers for interrupting current in power delivery systems. When closed, the circuit breaker "makes" the circuit (i.e., the electrical contacts within the circuit breaker are connected). When opened, the circuit breaker "breaks" the circuit (i.e., the electrical contacts are separated). In emergency operations, this circuit breaking process protects the other components of the circuit from catastrophic damage due to surpassing the overload current (such as overcurrent).

In high voltage electrical systems such as those that exist in large power plants (typical over 100 MW), the vacuum interrupters used in such systems are subject to high rated currents and high interruption currents. The performance requirements needed for generator vacuum circuit breakers present significant design challenges, as the high rated current requires large contact force and electrode size to keep the temperature rise low at the electrode terminals. Likewise, large switching mechanisms are needed to provide the required contact force keeping the electrical contacts connected during normal operations. Meanwhile, the high interruption currents require large contacts with special contact and electrode assembly design for vacuum interrupters to achieve successful current interruption.

This document describes a novel solution that addresses at least some of the issues described above.

SUMMARY

In an embodiment, a circuit breaker includes a movable tulip contact and a vacuum interrupter. To connect the circuit, the circuit breaker is between a first terminal and a second terminal. As an example, in some embodiments, a stationary contact may be electrically connected to the first terminal and the tulip contact may be moved onto and off of the stationary contact to make or break the circuit. As an example, in one embodiment, the tulip contact may include a first end having a plurality of contact fingers configured to removably attach to the stationary contact, and a second end that is electrically connected to the second terminal. As an example, in some embodiments, the vacuum interrupter may include a first electrode assembly that may be electrically connected to the first terminal, and a second electrode assembly that may be electrically connected to the second terminal. The tulip contact and stationary contact may provide a first conductive path from the first terminal to the second terminal when the tulip contact is connected to the stationary contact. The vacuum interrupter may provide a second conductive path from the first terminal to the second terminal when the vacuum interrupter is in a closed position.

In various embodiments, the circuit breaker may be a multi-stage circuit breaker having multiple stages of operation. A first stage may occur when the tulip contact is connected to the stationary contact, the vacuum interrupter is in a closed position, and the tulip contact and stationary contact provide a first conductive path from the first terminal to the second terminal. A second stage may occur when the tulip contact is separated from the stationary contact, the vacuum interrupter is in a closed position, and the vacuum interrupter provides a second conductive path from the first terminal to the second terminal. A third stage may occur when the tulip contact is separated from the stationary contact, the vacuum interrupter is in an open position, and the first conductive path and second conductive path are interrupted.

Optionally, the vacuum interrupter and the second conductive path may be positioned at least partially within the tulip contact when the tulip contact is connected to the stationary contact.

Optionally, the tulip contact may be configured to withdraw from and expose the vacuum interrupter when the tulip contact is separated from the stationary contact and moved to an open position.

Optionally, the vacuum interrupter may be positioned outside of the tulip contact so that the first conductive path and the second conductive path are electrically connected in parallel to each other.

Optionally, the tulip contact may be configured to interrupt up to a rated current of the circuit breaker when the tulip contact is separated from the stationary contact and moved to an open position and the vacuum interrupter may be configured to interrupt a short circuit current when the first electrode assembly and the second electrode assembly are separated to open the vacuum interrupter.

Optionally, the first electrode assembly may be a fixed assembly having a first coil and a first contact plate that is positioned between the first coil and the second electrode assembly. The second electrode assembly may be a movable electrode assembly having a second coil and a second contact plate that is positioned between the second coil and the first electrode assembly.

Optionally, the circuit breaker may include a drive assembly. The drive assembly may switch the circuit breaker from a closed configuration to an open configuration by interrupting the first conductive path and second conductive path. The drive assembly may interrupt the first conductive path by separating the tulip contact from the stationary contact and moving the tulip contact to a distance that is at least a length of the vacuum interrupter away from the stationary contact. After the tulip contact separates from the stationary contact, the drive assembly may interrupt the second conductive path by separating the first electrode assembly of the vacuum interrupter from the second electrode assembly of the vacuum interrupter.

Optionally, the circuit breaker may include a first drive assembly and a second drive assembly. The first drive assembly may switch the circuit breaker from a closed configuration to an open configuration by interrupting the first conductive path. The second drive assembly may switch the circuit breaker from a closed configuration to an open configuration by interrupting the second conductive path. The first drive assembly may interrupt the first conductive path by separating the tulip contact from the stationary contact and moving the tulip contact to a distance that is at least a length of the vacuum interrupter away from the stationary contact. The second drive assembly may, after the tulip contact reaches the distance, interrupt the second conductive path by separating the first electrode assembly of the vacuum interrupter from the second electrode assembly of the vacuum interrupter. The second drive assembly may include a contact spring between the second electrode assembly and the second terminal. The contact spring may include a shunt electrical connection. In some embodiments, the second terminal is movable, and a set of busbars electrically connects the second end of the tulip contact to the second terminal.

During operation, when the tulip contact separates from the stationary contact, the vacuum interrupter may remain in a closed position for a first period to carry the current until the tulip contact is sufficiently separated from the stationary contact to avoid electrical breakdown and arcing.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art.

As used in this document, the term "comprising" means "including, but not limited to." When used in this document, the term "exemplary" is intended to mean "by way of example" and is not intended to indicate that a particular exemplary item is preferred or required. In this document, when terms such "first" and "second" are used to modify a noun, such use is simply intended to distinguish one item from another, and is not intended to require a sequential order unless specifically stated.

The terms "about" and "approximately," when used in connection with a numeric value, are intended to include values that are close to, but not exactly, the number. For example, in some embodiments, the term "approximately" may include values that are within +/−10 percent of the value.

When used in this document, terms such as "top" and "bottom," "upper" and "lower," or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The drawings are not to scale. The claims are intended to include all orientations of a device containing such components.

In this document, the term "electrically connected" means, with respect to two or more components, that a conductive path exists between the components so that electric current can flow from one of the components to the other, either directly or through one or more intermediary components.

Figure 1:
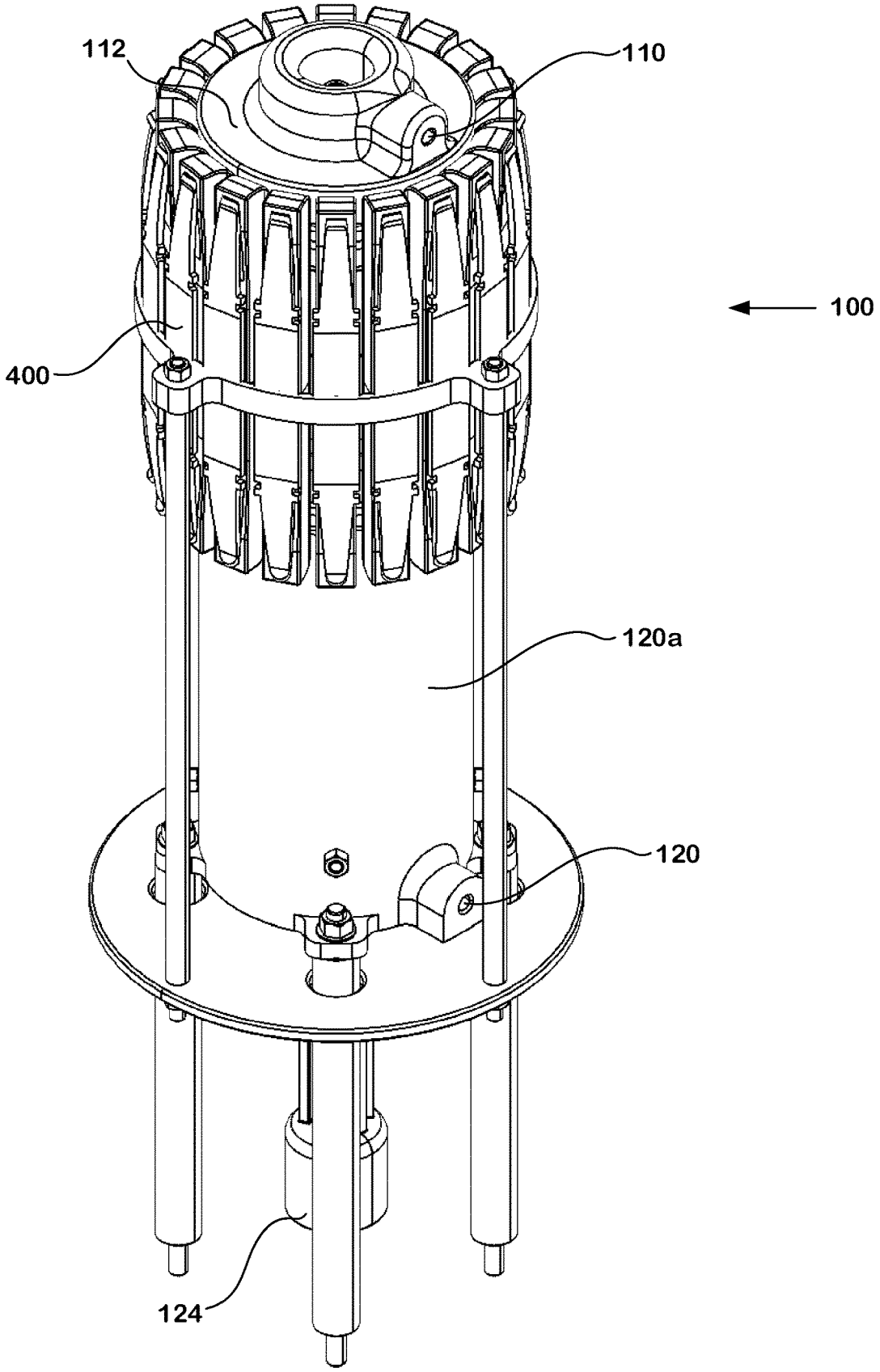
FIG. 1 is an isometric view of an example circuit breaker employing a vacuum interrupter and tulip contact.

Referring to FIG. 1, an example circuit breaker 100 may be positioned between a first terminal 110 and a second terminal 120. The first terminal 110 may be a line terminal and the second terminal 120 may be a load terminal. Alternatively, the first terminal 110 may be the load terminal and the second terminal 120 may be the line terminal. The circuit breaker 100 may connect the first terminal 110 to the second terminal 120 to "make" a circuit (i.e., to form a continuous loop) allowing the flow of electrical current. Conversely, to "break" a circuit (i.e., to open the loop) stopping the flow of electrical current, the circuit breaker 100 may separate the first terminal 110 from the second terminal 120.

The first terminal 110 may be electrically connected to a stationary contact 112 and the second terminal 120 may be electrically connected to a movable tulip contact 400 for contacting the stationary contact 112 in a closed position or for separating from the stationary contact 112 in an open position, as will be described in more detail below.

A tulip contact creates a biased connection between two electrical components and may also be used in a switch. A common tulip contact includes a base and two or more petals extending from the base. Each petal has an inwardly biased distal end for pressing against a stationary contact surface on the other electrical component. Separation of the tulip contact from the stationary contact requires sliding the distal ends of each petal along the peripheral surface of the stationary contact until separation occurs. Upon separation, electrical short circuit arcs between the stationary contact and the tulip contact are formed. For small tulip contacts used in low voltage and low current electrical systems, the short circuit arc is very small, but for large tulip contacts found in medium voltage or high voltage with high current electrical systems, the short circuit arc can be very large. After further separation distance is reached, all electrical short circuit arcs between the stationary contact and the tulip contact are discharged. Thus, the systems used in this document incorporates both a tulip contact 400 and a vacuum interrupter 300. A vacuum interrupter is another switch which uses electrical contacts in a vacuum enclosure (such as vacuum envelope). Separation of the electrical contacts within the vacuum envelope results in a metal vapor arc, which is quickly extinguished at current zero. In these embodiments during opening, the tulip contact 400 breaks the rated current, while the vacuum interrupter 300 breaks the short circuit current. The tulip contacts will carry the majority of the current when the circuit breaker is closed. During the opening process, the tulip contact separates, and minimal arcing should occur across the tulip contact 400, as all current will quickly commutate from the tulip contact's current path to the vacuum interrupter contact path. The vacuum interrupter 300 finally interrupts the circuit when its contacts separate.

A drive mechanism 124 may be connected to the tulip contact 400 adjacent the second terminal 120 to move the tulip contact 400 into the open and closed positions. Alternatively, the first terminal 110 may have a movable contact (similar in construction as the stationary contact 112) and the second terminal 120 may include a fixed tulip contact (similar in construction as the movable tulip contact 400), wherein the movable contact is driven to separate from the fixed tulip contact. During operation, the tulip contact 400 will be separated from one of the terminals while the vacuum interrupter 300 remains closed for a brief first period of time that is sufficient to allow the tulip contact 400 to separate far enough away from the terminal to avoid arcing. This time period may vary depending on the size and speed of operation of the system. After the first period of time, the vacuum interrupter 300 will be opened to complete interruption of the circuit.

Figure 2:
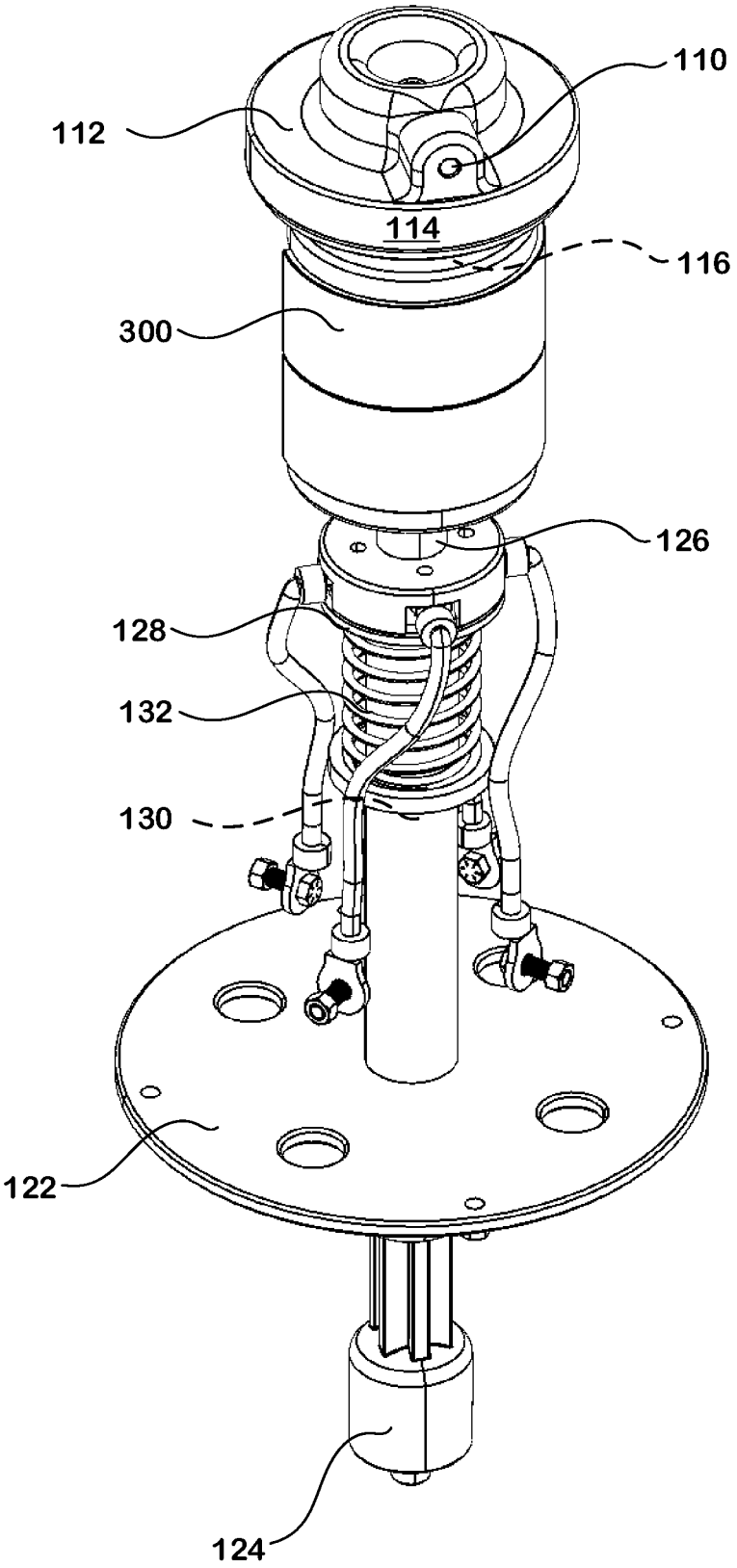
FIG. 2 is an isometric view of the circuit breaker of FIG. 1 with the tulip contact removed.
Figure 6:
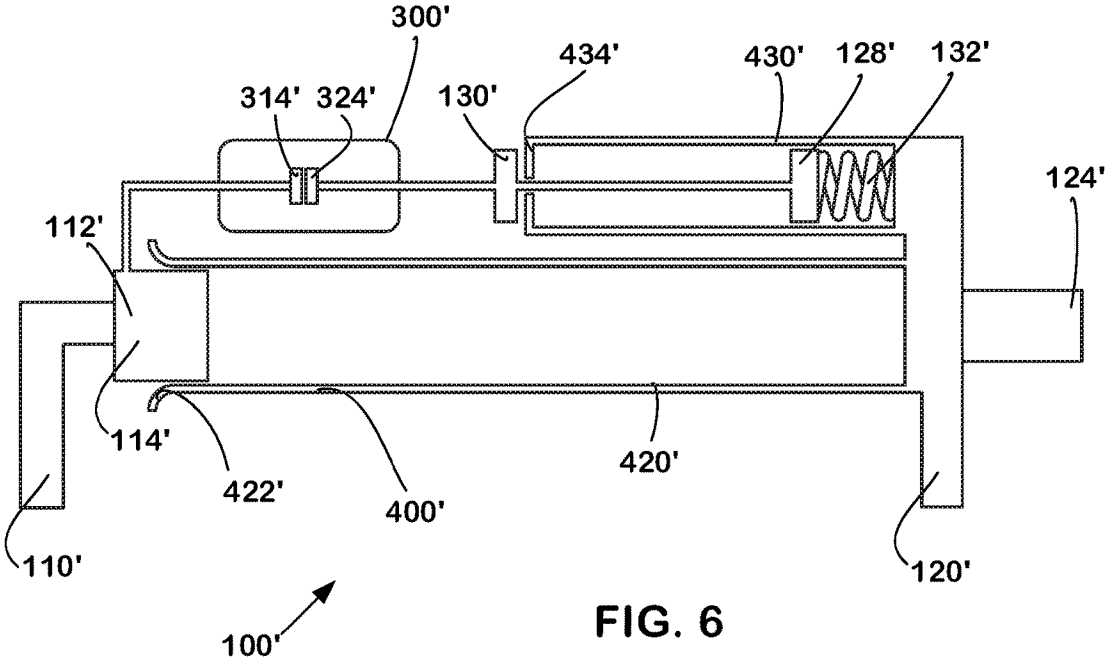
FIG. 6 is a schematic illustration of an example circuit breaker with an external vacuum interrupter.

FIG. 2 is an isometric view of the circuit breaker 100 of FIG. 1 with the tulip contact 400 removed. One or more vacuum interrupters 300 may be positioned at least partially within the periphery of the tulip contact 400 or, alternatively, may be positioned outside of and away from the periphery of the tulip contact 400 and/or a combination of both. For example, as illustrated in FIG. 2, a single vacuum interrupter 300 is positioned within the periphery of the tulip contact 400. Alternatively, as illustrated in FIG. 6, the vacuum interrupter 300' may be positioned outside of the tulip contact 400', along a parallel conductive path from the first terminal 110' to the second terminal 120'.

The stationary contact 112 may have any shape, optionally matching (or complementing) that of the perimeter of the tulip contact 400. For example, the stationary contact 112 may have a cylindrical shape with a peripheral outer surface 114. Alternatively, the stationary contact 112 may have an oval, triangular, square, rectangular, or the like shape, with the respective tulip contact 400 having a similar-shaped periphery so that the tulip contact 400 surrounds and contacts the stationary contact 112 in a closed position.

A fixed electrode 116 (see FIG. 3) may be electrically connected to the first terminal 110 and extend into one end of the vacuum interrupter 300 and a movable electrode 126 may be electrically connected to the second terminal 120 and extend into the opposite end of the vacuum interrupter 300. For example, the fixed electrode 116 may extend from the stationary contact 112 and the movable electrode 126 may slidably extend from the vacuum interrupter 300, as will be described in more detail below. The movable electrode 126 may also include an opening stop 128 and a closing stop 130, as will be described in more detail below. A contact spring 132 may be positioned between the opening stop 128 of the movable electrode 126 and the second terminal 120. The contact spring 132 may have a low spring rate and may include a separate shunt to provide an electrical connection between the vacuum interrupter 300 and the second terminal 120.

Figure 3:
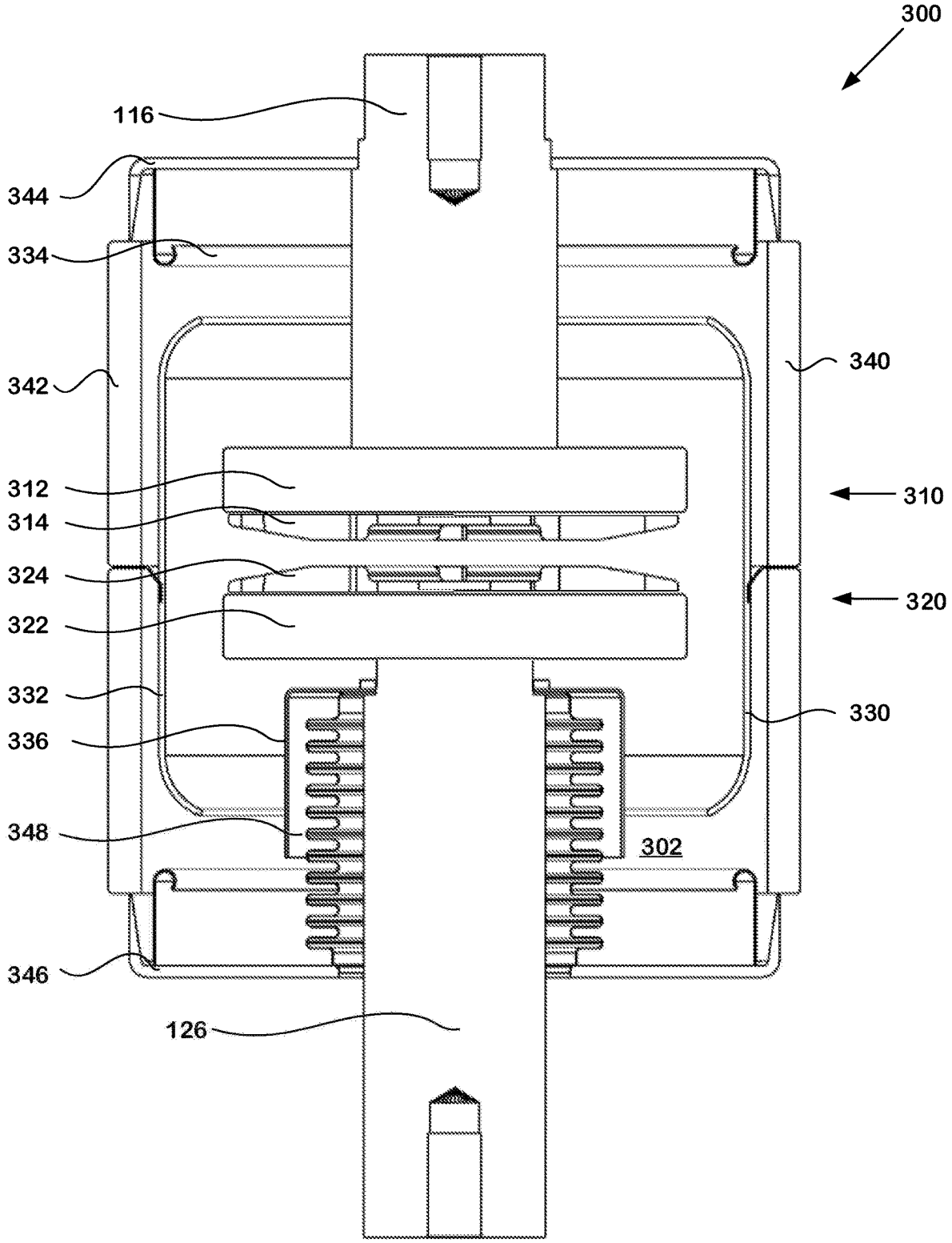
FIG. 3 is a sectional view of an example vacuum interrupter.

FIG. 3 is a sectional view of an example vacuum interrupter 300. The vacuum interrupter 300 may include a fixed electrode assembly 310 connected to the fixed electrode 116 and a movable electrode assembly 320 connected to the movable electrode 126. The fixed electrode assembly 310 may include a coil 312 and a contact plate 314. The movable electrode assembly 320 may also include a coil 322 and a contact plate 324. Each coil 312, 322 may have one or more arcuate arms either in the same plane or slanted so as to overlap one another. For example, each coil 312, 322 may have a single arm connected to an electrode 116, 126, extending radially outward, following a perimeter of the coil almost to a near circle within the same plane, and terminating in a connection to a contact plate 314, 324, respectively. The arcuate arms of each coil 312, 322 rotate in opposite directions. During operation of the circuit, the two coils 312, 322 generate magnetic fields that are opposite to each other in order to generate an attractive force (i.e., Lorentz force) to keep the contact plates 314, 324 closed for a first period of time that is sufficient to allow the tulip contact to separate far enough away from the stationary contact to avoid arcing. A vapor shield 330 may surround the fixed electrode assembly 310 and movable electrode assembly 320. The vapor shield 330 may include a fixed cylindrical member 332, a fixed end member 334, and a movable end member 336. The fixed end member 334 may be planar and the moveable end member 336 may be cup-shaped. The fixed end member 334 of the vapor shield 330 may be connected to the fixed electrode 116 and the movable end member 336 may be connected to the movable electrode 126. An enclosure 340 may create a vacuum envelope 302 and surround the vapor shield 330. The enclosure 340 may include an insulating cylindrical member 342, a first end member 344, a second end member 346, and a bellows 348. The first end member 344 of the enclosure 340 may be connected to the fixed electrode 116 and the bellows 348 may be connected to the movable electrode 126. The fixed cylindrical member 332 of the vapor shield 330 may be connected to the insulating cylindrical member 342 of the enclosure 340. The movable end member 336 of the vapor shield 330 may be positioned to protect the bellows 348 of the enclosure 340 from overheating during an interruption event. The bellows 348 permits the movable electrode assembly 320, movable electrode 126, and movable end member 336 of the vapor shield 330 to move away from the other components of the vacuum interrupter 300 during an interruption event.

Figure 4:
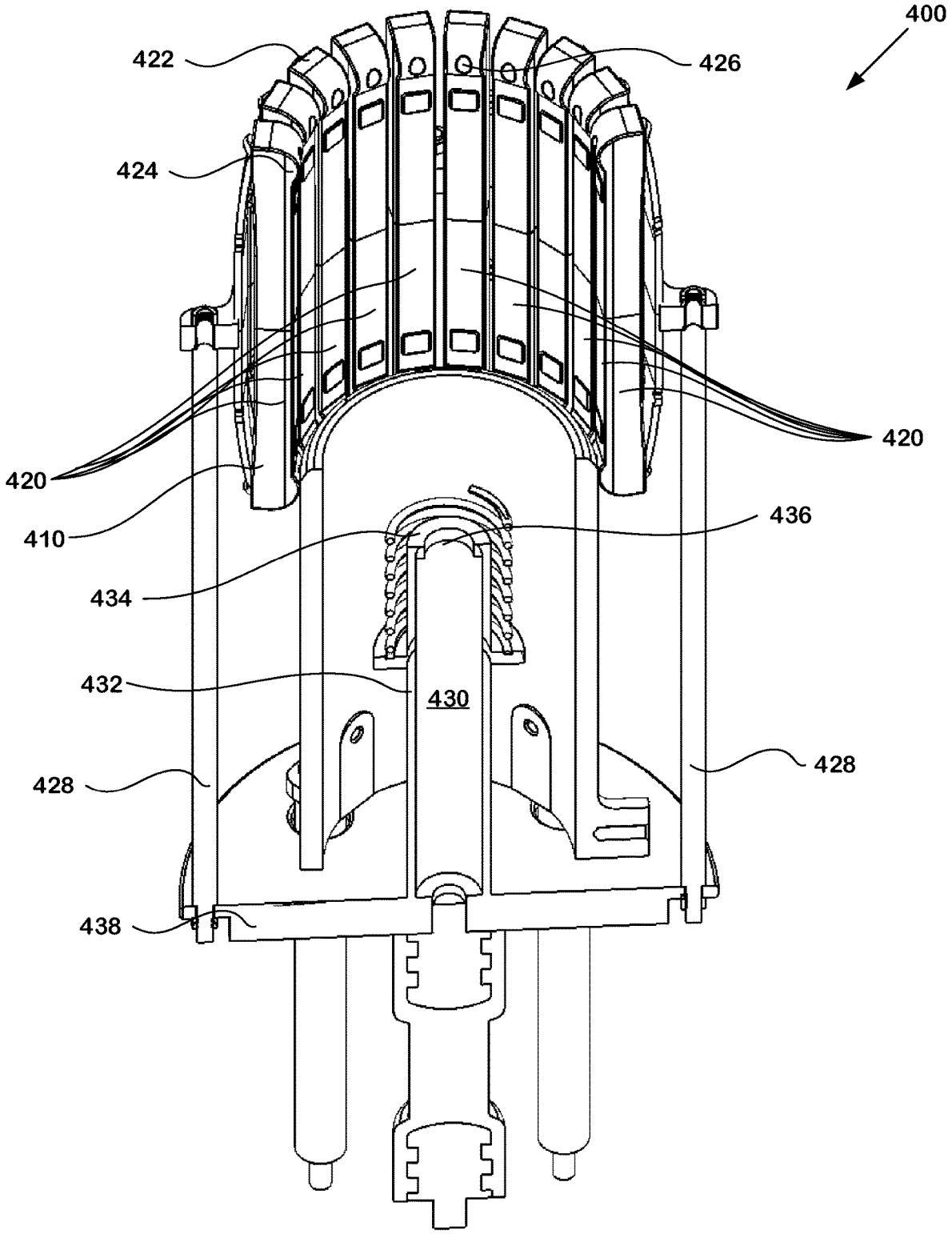
FIG. 4 is a sectional view of an example tulip contact.

FIG. 4 is a sectional view of an example tulip contact 400. The tulip contact 400 may have a base 410 and a plurality of petals 420 extending from the base 410 to a distal end 422. For example, the tulip connector 400 may be made from a highly conductive material, such as copper (Cu), a copper-tungsten alloy (such as CuW or WCu), aluminum (Al), or the like. The base 410 may be attached to the second terminal 120 or may move independently from the second terminal 120. For example, as illustrated in FIG. 4, the base 410 of the tulip contact 400 is slidably connected to the outer wall of the second terminal 120. Each petal 420 is an extended member (such as a rod) that extends from the base 410 and which collectively are positioned around the stationary contact 112 when in a closed position. The distal end 422 of each petal 420 is biased inwardly. In the closed position, the petals 420 radially apply force against the peripheral outer surface 114 of the stationary contact 112 due to the inherent spring force designed into the biased petals. The distal end 422 of each petal 420 allows the tulip contact 400 to separate from the stationary contact 112 in a sliding motion. For example, the inner surface of each petal 420 near the distal end 422 may have a raised portion 424. Likewise, a secondary material 426 having a coefficient of friction lower than the material of the petal 420 may be added to the inner surface of each petal 420 near the distal end 422 to assist in sliding separation from the stationary contact 112. For example, the secondary material 426 may be made from a material having a low coefficient of friction, such as copper (Cu), a copper-tungsten alloy (such as CuW or WCu), silver (Ag), gold (Au), or the like. The distal end 422 of each petal may also allow for sliding reconnection of the tulip contact 400 to the stationary contact 112. For example, the distal end 422 of each petal 420 may have an outwardly protruding (i.e., curved) tip forming an inner angled surface having an outer diameter larger than the outer diameter of the stationary contact 112 and an inner diameter smaller than the outer diameter of the stationary contact 112 so as to provide a sliding interference fit when the tulip contact 400 is reconnected to the peripheral outer surface 114 of the stationary contact 112 as will be described below.

A property of a switch having a tulip contact and a stationary contact is that the electrical current I (amperage) passing across the switch is not significantly diminished. If a tulip contact has n petals (where n equals the total number of petals), then the electrical current passing across each petal is I/n. The electrical current passing across the base of the tulip contact is I, passing across all petals is n*I/n=I, and passing across the stationary contact is I.

Tulip contacts 400 generates significant self-induced magnetic force of attraction during high current operations, such that each petal 420 is attracted inward when a large electrical current passes across the distal ends 422 to the peripheral outer surface 114 of the stationary contact 112. Circular tulip contacts 400 have a greater magnetic inward force when compared to non-circular tulip contacts. Without the magnetic property of attraction caused by the tulip contact 400, the circuit breaker for high current electrical systems would require a very large mechanism device to keep the tulip contacts 400' and stationary contact 112' closed due to the large repulsive force (such as constriction or Holm force) under high electrical current. With this magnetic characteristic of attraction, the vacuum interrupter 300 may operate with a much smaller mechanism device to keep the contact plates 314, 324 closed as majority of the high current will flow through the tulip contacts. For example, the contact spring 132 with a low spring force and spring rate is able to keep the connection between the contact plates 314, 324 during an inrush or over-current event.

To open the tulip contact 400 from the stationary contact 112 and to open the contact plates 314, 324 of the vacuum interrupter 300 in a sequential order, a pulling member 430 is provided with the tulip contact 400. For example, when the vacuum interrupter 300 is located within the periphery of the tulip contact 400, the pulling member 430 may also be within the periphery; when the vacuum interrupter 300 is located outside the periphery of the tulip contact 400, the pulling member 430 may also be located outside the periphery. The pulling member 430 may have an extension 432 and a catch 434. For example, the extension 432 may be a cylinder fixed to the tulip contact 400 via one or more bolts 428 fixed to a base 438 of the pulling member 430. For example, the catch 434 may be an end wall fixed to the extension 432 and may have an aperture 436 for receiving the movable electrode 126 of the vacuum interrupter 300. The opening stop 128 is pulled by the pulling member 430 and the closing stop 130 is pushed by the pulling member 430, as will be described in more detail below. For example, the opening stop 128 may be a wall located on the distal end of the movable electrode 126 and may be positioned between the catch 434 and the base 410. Likewise, the closing stop 130 may be another wall and may be positioned between the second end member 346 of the vacuum interrupter 300 and the catch 434. Optionally, the pulling member 430 may be a rod. When the pulling member 430 on the tulip contact 400 is pulled away from the stationary contact 112, the catch 434 pulls the opening stop 128. When the pulling member 430 on the tulip contact 400 is pushed back toward the stationary contact 112, the closing stop 130 limits the catch 434 from further movement, as will be described in more detail below.

Figure 5A:
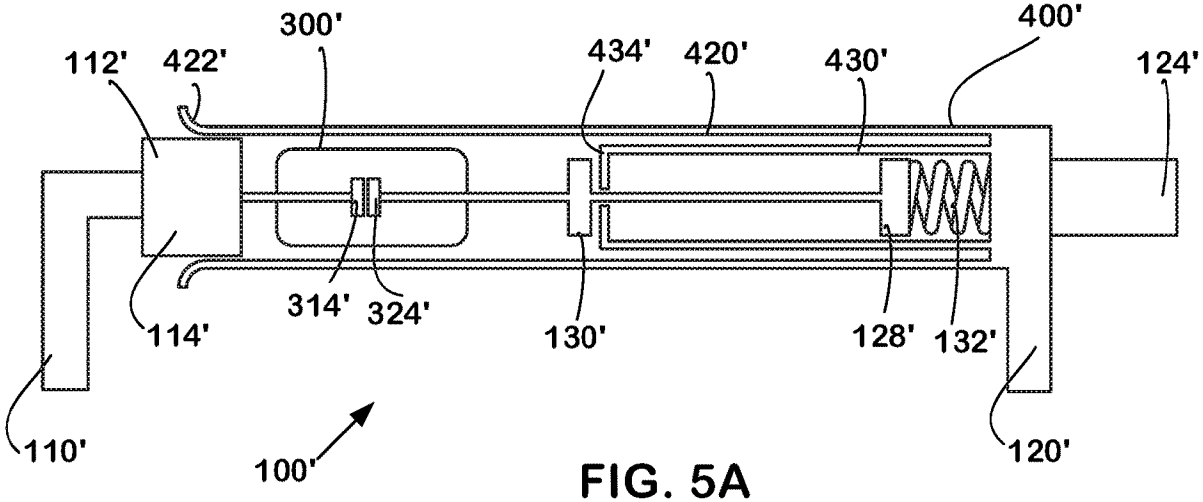
FIG. 5A is a schematic illustration of another example circuit breaker in a closed stage.

FIG. 5A is a schematic illustration of an alternate embodiment of a circuit breaker 100' in a closed stage connecting the first terminal 110' to the second terminal 120'. The distal ends 422' of the petals 420' of the tulip contact 400' press against the peripheral surface 114' of the stationary contact 112' providing a first conductive path from the first terminal 110' to the second terminal 120'. The contact spring 132' biases the opening stop 128' toward the stationary contact 112'. The catch 434' of the pulling member 430' is limited by the closing stop 130' preventing the distal ends 422' of the tulip contact 400' from extending past the stationary contact 112'. During normal electrical operations, the self-induced magnetic force between the petals 420' and the peripheral surface 114' is large enough to prevent contact blow-open and arcing due to the constriction force between the petals 420' and the peripheral surface 114'. A majority of the current flows through the tulip contacts. This allows the contact spring 132', having a low spring force, to maintain the contact plates 314', 324' of the vacuum interrupter 300' in contact, thus providing a second conductive path from the first terminal 110' to the second terminal 120'.

Figure 5B:
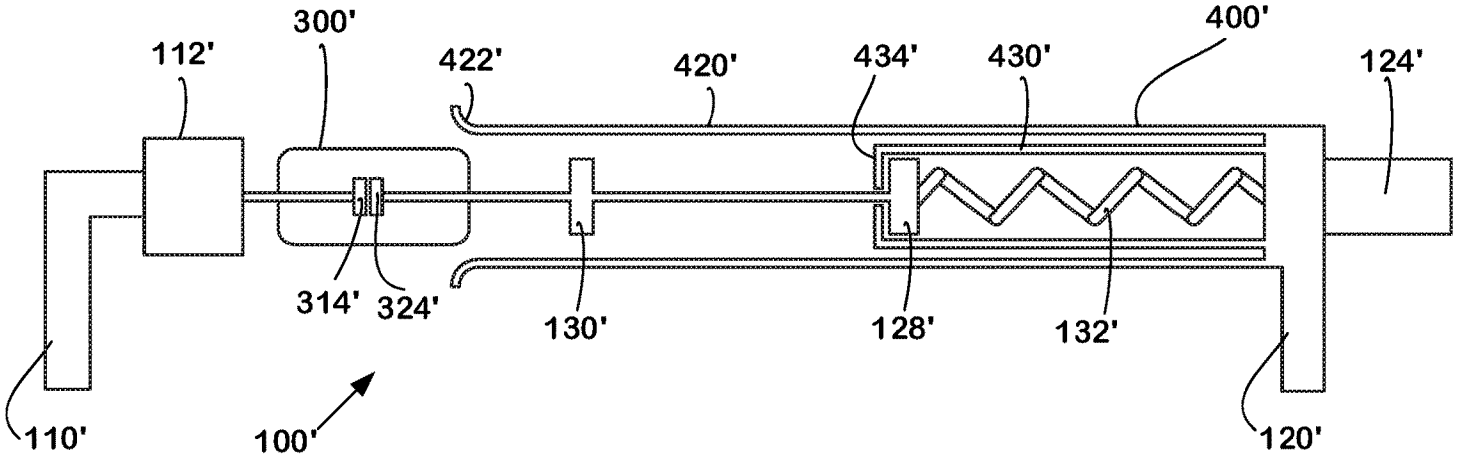
FIG. 5B is a schematic illustration of the circuit breaker of FIG. 5A in an intermediate stage.

FIG. 5B is a schematic illustration of the circuit breaker 100' of FIG. 5A in an intermediate stage, such that a signal is delivered to the drive mechanism 124' to turn on, commutating the current from the tulip contacts to the vacuum interrupter by partially opening the circuit to the point where the distal ends 422' of the petals 420' of the tulip contact 400' have cleared the vacuum interrupter 300'. The signal to the drive mechanism 124' to turn on may be in response to a short circuit detection or by a user performing maintenance on the circuit. The first conductive path across the tulip contact 400' is now open (such as broken), while the second conductive path across the vacuum interrupter 300' remains closed (such as made). The catch 434' of the pulling member 430' has moved from the closing stop 130' to the opening stop 128'. The second conductive path has eliminated any short circuit arcs between the stationary contact 112' and the distal ends 422' of the petals 420' of the tulip contact 400' that would have occurred without a vacuum interrupter 300' present. At the moment the distal ends 422' of the petals 420' of the tulip contact 400' have cleared the vacuum interrupter 300' there is a large repulsion force across the contacts present in the circuit breaker 100' to pull the contact plates 314', 324' of the vacuum interrupter 300' apart. This large force in part counteracts the large Lorentz force induced by the coil (not shown in FIG. 5B, but see 312, 322 in FIG. 3) attracting the contact plates 314', 324' together allowing for a very small force to keep the contact plates 314', 324' together for a brief period of time sufficient to permit the tulip contact 400' to separate.

Figure 5C:
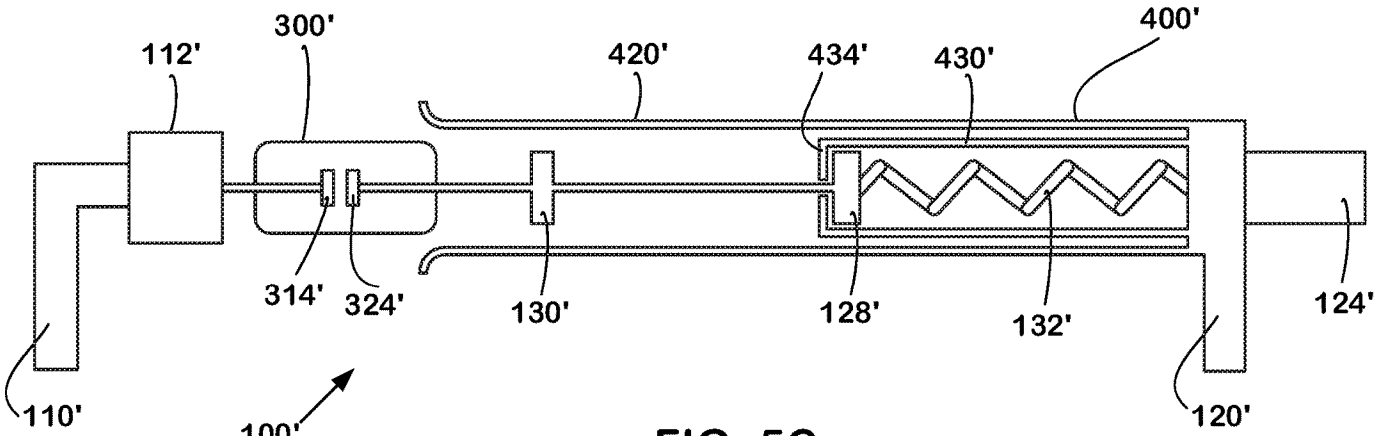
FIG. 5C is a schematic illustration of the circuit breaker of FIG. 5A in an open stage.

FIG. 5C is a schematic illustration of the circuit breaker 100' in an open stage, such that the drive mechanism 124' has completely opened the circuit to the point where the contact plates 314', 324' of the vacuum interrupter 300' have been pulled apart by the catch 434' pulling on the opening stop 128'. The transition from the intermediate stage to the open stage occurs very quickly. The trigger for the vacuum interrupter 300' may occur no more than a few milliseconds after the triggering of the tulip contact 400'. Optionally, the drive mechanisms for the tulip contact 400 and the vacuum interrupter 300 can be separate ones and controlled separately. For example, the vacuum interrupter 300' may be triggered while the tulip contact 400' is still in motion or, alternatively, after the tulip contact 400' is fully open. Both the first and second conductive paths are now open (i.e., the circuit is broken).

To reconnect the first terminal 110' and the second terminal 120' (i.e., to make the circuit), the above steps are reversed. The drive mechanism 124' moves the tulip contact 400' toward the stationary contact 112'. The catch 434' of the pulling member 430' of the tulip contact 400' allows the opening stop 128' to be moved toward the vacuum interrupter 300'. After closing the second conductive path across the vacuum interrupter 300' and if electricity is present in the circuit, the attractive force (Lorentz force) present in the assemblies (not separately shown in FIGS. 5A-5C, but see assemblies 310, 320 of FIG. 3 for illustration) of the vacuum interrupter 300' would pull the contact plates 314', 324' together. As the tulip contact 400' moves further, the angled face of the distal ends 422' of the petals 420' of the tulip contact 400' would contact the outer edge of the stationary contact 112' forcing the petals 420' to spread outwardly thus causing an interference fit between the petals 420' and the peripheral surface 114' of the stationary contact 112'. If electricity is present in the circuit, the self-induced magnetic force between the petals 420' and the peripheral surface 114' of the stationary contact 112' would close the first conductive path across the tulip contact 400'. The catch 434' of the pulling member 430' would press against the closing stop 130', thus limiting the tulip contact 400' from further movement and a signal would be delivered to the drive mechanism 124' to turn off. The circuit is now made.

The tulip contact 400' can withstand high current without the need for a large switching mechanism to provide the required contact force within the vacuum interrupter 300', while the vacuum interrupter 300' is able to interrupt short circuit current with minimum contact gap. Likewise, the lower interruption current creates less arc erosion of the contact plates 314', 324' of the vacuum interrupter 300' which increases the usable lifespan of the vacuum interrupter 300'.

Figure 7:
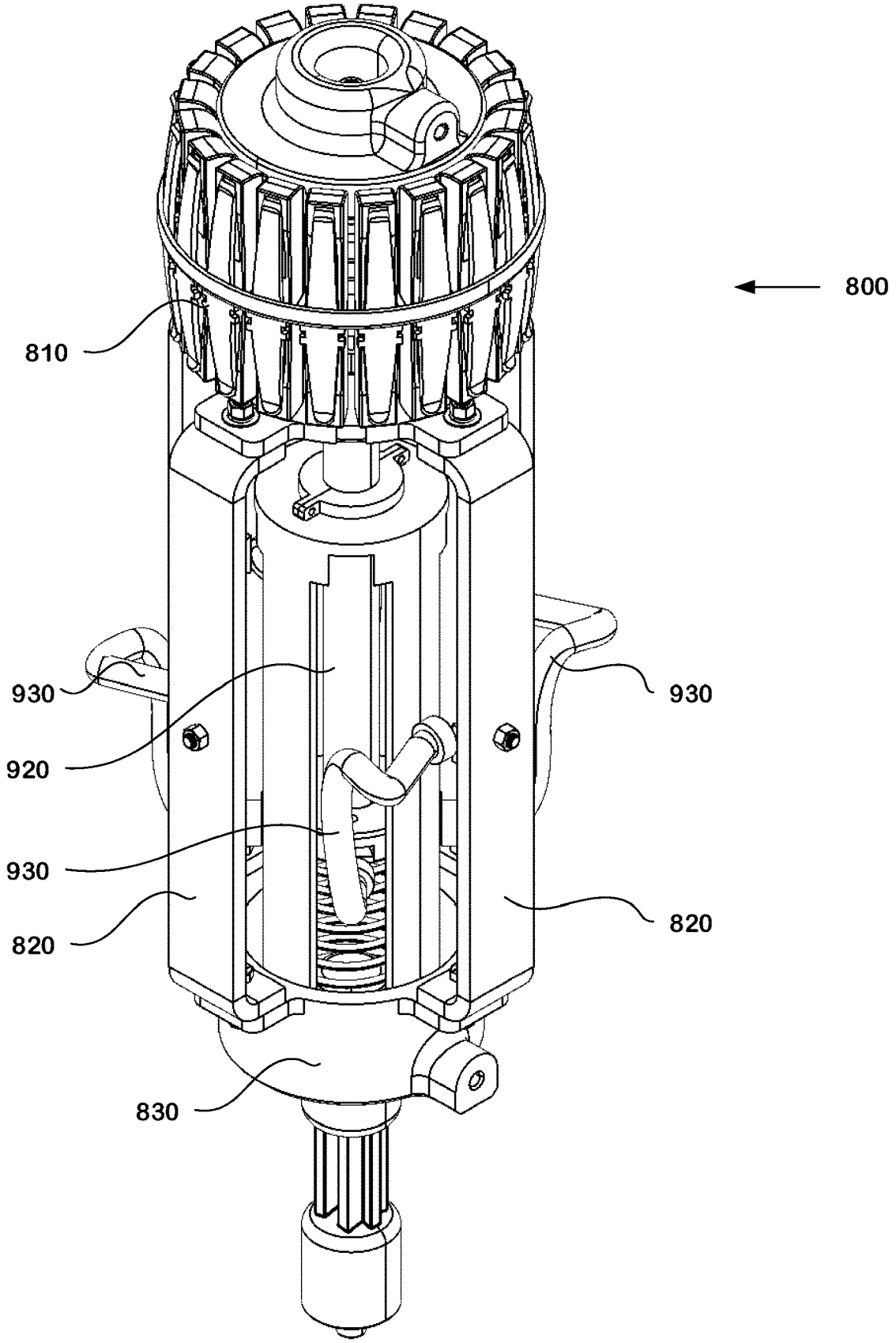
FIG. 7 is an isometric view of a third example circuit breaker employing a vacuum interrupter and tulip contact.
Figure 8:
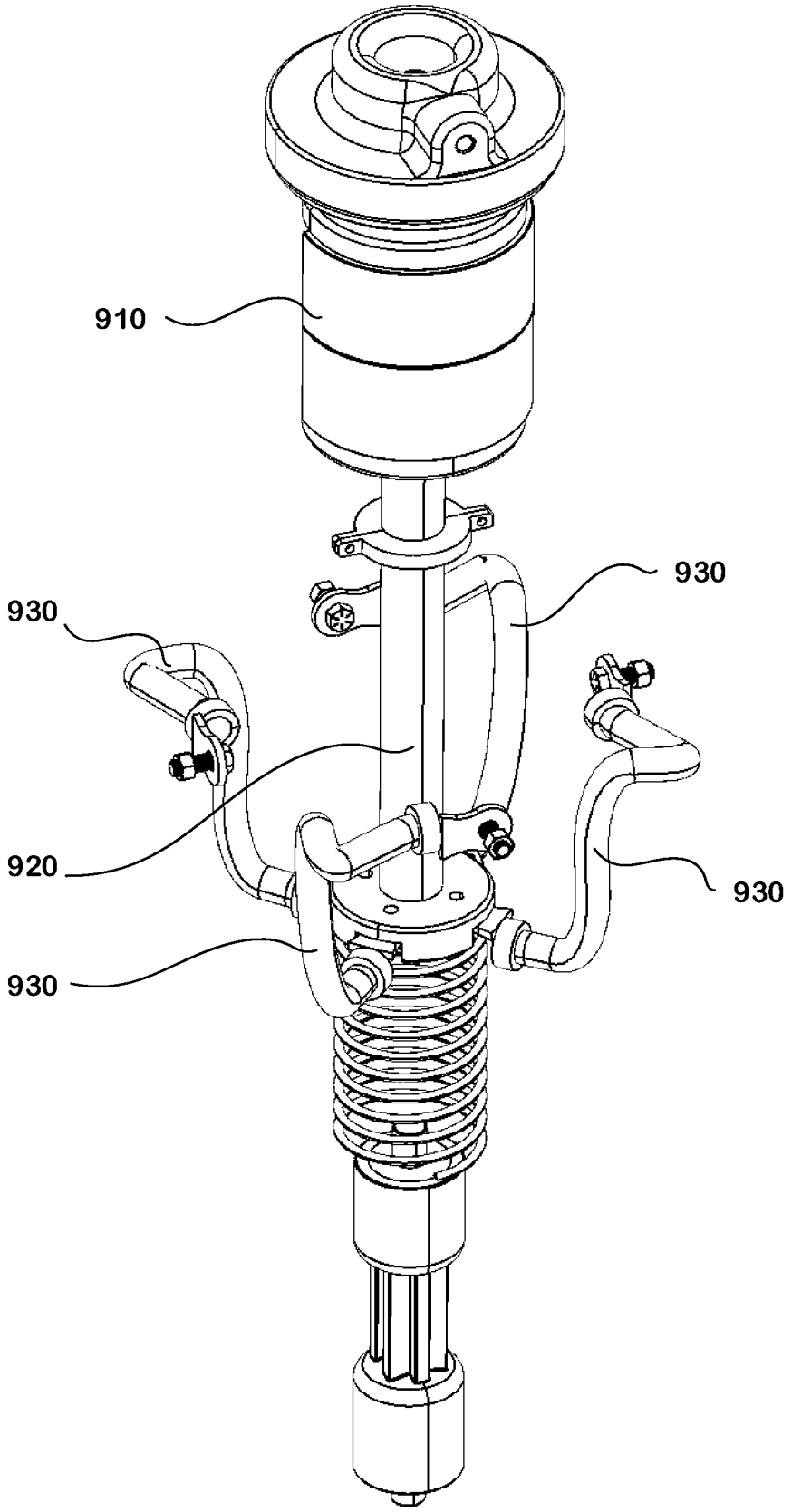
FIG. 8 is an isometric view of the circuit breaker of FIG. 7 with the tulip contact removed.
Figure 9:
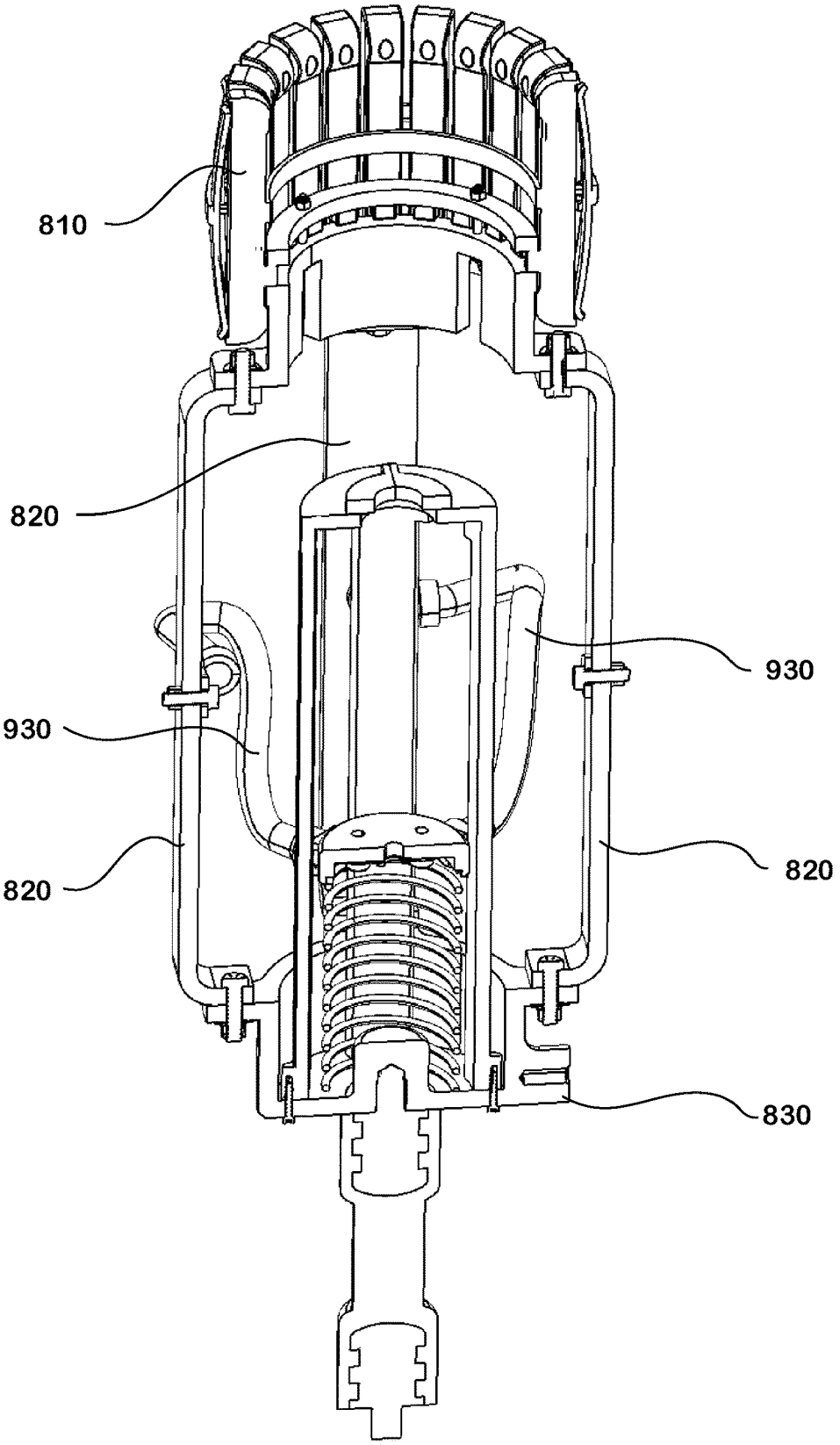
FIG. 9 is a sectional view of the example circuit breaker of FIG. 7.

The circuit breaker 100 of FIGS. 1-4 allows the tulip contact 400 to move (i.e., slide) along the conductive outer surface of a cylinder portion 120*a* of the second terminal 120. FIGS. 8-9 are isometric views of a third example circuit breaker 800 employing a vacuum interrupter 910 and tulip contact 810. FIG. 7 illustrates the full mechanism, while FIG. 8 reveals inner components of the mechanism that are at least partially hidden by the components of FIG. 7. FIG. 9 illustrates a cross sectional view of certain elements that appear in FIGS. 7 and 8. In this embodiment, a set of four (or any other appropriate number of) conductive busbars 820 electrically and mechanically connect the tulip contact 810 to a second terminal 830. The tulip contact 810 moves with the second terminal 830 during closing and opening operations. The bottom portion of this tulip contact 810 does not slide along a support member as performed by the tulip contact 100 in FIGS. 1-4. Instead, a movable electrode 920 extending from the vacuum interrupter 910 is part of a structure that moves with to the busbars 820 to pull the second end (lower end as shown) of the tulip contact 810 away from the first end of the tulip contact 810. Each of the busbars is electrically connected to a cables or other conductive member 930 that electrically connects the movable electrode 920 to the corresponding busbar 820.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A circuit breaker comprising:

a stationary contact that is electrically connected to a first terminal;

a movable tulip contact comprising:

a first end comprising a plurality of contact fingers configured to removably attach to the stationary contact, and a second end that is electrically connected to a second terminal, wherein the tulip contact and stationary contact provide a first conductive path from the first terminal to the second terminal when the tulip contact is connected to the stationary contact; and a vacuum interrupter comprising:

a first electrode assembly that is electrically connected to the first terminal, and a second electrode assembly that is electrically connected to the second terminal, wherein:

the vacuum interrupter provides a second conductive path from the first terminal to the second terminal when the vacuum interrupter is in a closed position, the second terminal is a movable terminal, and the circuit breaker further comprises a plurality of busbars that electrically connect the second end of the tulip contact to the second terminal.

2. The circuit breaker of claim 1, wherein the vacuum interrupter and the second conductive path are positioned at least partially within the tulip contact when the tulip contact is connected to the stationary contact.

3. The circuit breaker of claim 2, wherein the tulip contact is configured to withdraw from and expose the vacuum interrupter when the tulip contact is separated from the stationary contact and moved to an open position.

4. The circuit breaker of claim 1, wherein:

the tulip contact is configured to carry a majority of a rated current of the circuit breaker when the tulip contact is in a closed position; and the vacuum interrupter is configured to interrupt a short circuit current when the first electrode assembly and the second electrode assembly are separated to open the vacuum interrupter.

5. The circuit breaker of claim 1, wherein:

the first electrode assembly is a fixed electrode assembly and comprises:

a first coil comprising one or more arcuate arms, and a first contact plate that is positioned between the first coil and the second electrode assembly; and the second electrode assembly is a movable electrode assembly and comprises:

a second coil comprising one or more arcuate arms, and a second contact plate that is positioned between the second coil and the first electrode assembly.

6. The circuit breaker of claim 1, further comprising a drive assembly that is operable to switch the circuit breaker from a closed configuration to an open configuration by:

interrupting the first conductive path by separating the tulip contact from the stationary contact and moving the tulip contact to a distance that is at least a length of the vacuum interrupter away from the stationary contact; and after the tulip contact separates from the stationary contact, interrupting the second conductive path by separating the first electrode assembly of the vacuum interrupter from the second electrode assembly of the vacuum interrupter.

7. The circuit breaker of claim 1, further comprising:

a first drive assembly that is operable to interrupt the first conductive path by separating the tulip contact from the stationary contact and moving the tulip contact to a distance that is at least a length of the vacuum interrupter away from the stationary contact; and a second drive assembly that is operable to, after the tulip contact reaches the distance, interrupt the second conductive path by separating the first electrode assembly of the vacuum interrupter from the second electrode assembly of the vacuum interrupter.

8. The circuit breaker of claim 7, wherein the second drive assembly comprises a contact spring between the second electrode assembly and the second terminal.

9. A method of operating a circuit breaker, wherein:

the circuit breaker comprises:

a stationary contact that is electrically connected to a first terminal, a movable tulip contact, a vacuum interrupter comprising:

a first electrode assembly that is electrically contacted to the first terminal; and a second electrode assembly that is electrically connected to a movable second terminal, and a plurality of busbars that electrically connect the tulip contact to the second terminal; and the method comprises:

passing current through the circuit breaker while the tulip contact is connected to the stationary contact and the vacuum interrupter is in a closed position, so that the tulip contact and stationary contact provide a first conductive path from the first terminal to the second terminal, separating the tulip contact from the stationary contact for a first period while the vacuum interrupter is in the closed position, so that the first conductive path is interrupted and the vacuum interrupter provides a second conductive path from the first terminal to the second terminal, and after the first period, opening the vacuum interrupter by separating the first electrode assembly from the second electrode assembly to result in both the first conductive path and the second conductive path being interrupted.

10. The method of claim 9, wherein the vacuum interrupter and the second conductive path are positioned at least partially within the tulip contact when the tulip contact is connected to the stationary contact.

11. The method of claim 10, wherein separating the tulip contact from the stationary contact also withdraws the tulip contract from and exposes the vacuum interrupter.

12. The method of claim 9, wherein:

the vacuum interrupter interrupts a short circuit current when the first electrode assembly and the second electrode assembly are separated to open the vacuum interrupter.

13. The method of claim 9, wherein:

the first electrode assembly is a fixed electrode assembly and comprises:

a first coil comprising one or more arcuate arms, and a first contact plate that is positioned between the first coil and the second electrode assembly; and the second electrode assembly is a movable electrode assembly and comprises:

a second coil comprising one or more arcuate arms, and a second contact plate that is positioned between the second coil and the first electrode assembly.

14. The method of claim 9, further operating a drive assembly to switch the circuit breaker from a closed configuration to an open configuration by:

interrupting the first conductive path by separating the tulip contact from the stationary contact and moving the tulip contact to a distance that is at least a length of the vacuum interrupter away from the stationary contact; and after the tulip contact separates from the stationary contact, interrupting the second conductive path by separating the first electrode assembly of the vacuum interrupter from the second electrode assembly of the vacuum interrupter.

15. The method of claim 9, further comprising:

operating a first drive assembly to interrupt the first conductive path by separating the tulip contact from the stationary contact and moving the tulip contact to a distance that is at least a length of the vacuum interrupter away from the stationary contact; and operating a second drive assembly to, after the tulip contact reaches the distance, interrupt the second conductive path by separating the first electrode assembly of the vacuum interrupter from the second electrode assembly of the vacuum interrupter.

16. The method of claim 15, wherein the second drive assembly comprises a contact spring between the second electrode assembly and the second terminal.

17. The method of claim 9, wherein a Lorentz force maintains the vacuum interrupter in the closed position during the first period.

18. A circuit breaker comprising:

a stationary contact that is electrically connected to a first terminal;

a movable tulip contact comprising:

a first end comprising a plurality of contact fingers configured to removably attach to the stationary contact, and a second end that is electrically connected to a second terminal, wherein the tulip contact and stationary contact provide a first conductive path from the first terminal to the second terminal when the tulip contact is connected to the stationary contact; and a vacuum interrupter comprising:

a first electrode assembly that is electrically connected to the first terminal, and a second electrode assembly that is electrically connected to the second terminal, wherein:

the vacuum interrupter provides a second conductive path from the first terminal to the second terminal when the vacuum interrupter is in a closed position; and the vacuum interrupter and the second conductive path are positioned at least partially within the tulip contact when the tulip contact is connected to the stationary contact.

19. The circuit breaker of claim 18, wherein the second terminal is a movable terminal.

20. The circuit breaker of claim 18, wherein the tulip contact is configured to withdraw from and expose the vacuum interrupter when the tulip contact is separated from the stationary contact and moved to an open position.

21. The circuit breaker of claim 18, wherein:

the tulip contact is configured to carry a majority of a rated current of the circuit breaker when the tulip contact is in a closed position; and the vacuum interrupter is configured to interrupt a short circuit current when the first electrode assembly and the second electrode assembly are separated to open the vacuum interrupter.

22. The circuit breaker of claim 18, wherein:

the first electrode assembly is a fixed electrode assembly and comprises:

a first coil comprising one or more arcuate arms, and a first contact plate that is positioned between the first coil and the second electrode assembly; and the second electrode assembly is a movable electrode assembly and comprises:

a second coil comprising one or more arcuate arms, and a second contact plate that is positioned between the second coil and the first electrode assembly.

23. The circuit breaker of claim 18, further comprising a drive assembly that is operable to switch the circuit breaker from a closed configuration to an open configuration by:

interrupting the first conductive path by separating the tulip contact from the stationary contact and moving the tulip contact to a distance that is at least a length of the vacuum interrupter away from the stationary contact; and after the tulip contact separates from the stationary contact, interrupting the second conductive path by separating the first electrode assembly of the vacuum interrupter from the second electrode assembly of the vacuum interrupter.

24. The circuit breaker of claim 18, further comprising:

a first drive assembly that is operable to interrupt the first conductive path by separating the tulip contact from the stationary contact and moving the tulip contact to a distance that is at least a length of the vacuum interrupter away from the stationary contact; and a second drive assembly that is operable to, after the tulip contact reaches the distance, interrupt the second conductive path by separating the first electrode assembly of the vacuum interrupter from the second electrode assembly of the vacuum interrupter.

25. The circuit breaker of claim 24, wherein the second drive assembly comprises a contact spring between the second electrode assembly and the second terminal.

26. A method of operating a circuit breaker, wherein:

the circuit breaker comprises:

a stationary contact that is electrically connected to a first terminal, a movable tulip contact, and a vacuum interrupter comprising:

a first electrode assembly that is electrically contacted to the first terminal; and a second electrode assembly that is electrically connected to a second terminal; and the method comprises:

passing current through the circuit breaker while the tulip contact is connected to the stationary contact and the vacuum interrupter is in a closed position, so that the tulip contact and stationary contact provide a first conductive path from the first terminal to the second terminal, separating the tulip contact from the stationary contact for a first period while the vacuum interrupter is in the closed position, so that the first conductive path is interrupted and the vacuum interrupter provides a second conductive path from the first terminal to the second terminal, and after the first period, opening the vacuum interrupter by separating the first electrode assembly from the second electrode assembly to result in both the first conductive path and the second conductive path being interrupted, wherein the vacuum interrupter and the second conductive path are positioned at least partially within the tulip contact when the tulip contact is connected to the stationary contact.

27. The method of claim 26, wherein separating the tulip contact from the stationary contact also withdraws the tulip contract from and exposes the vacuum interrupter.

28. The method of claim 26, wherein:

the vacuum interrupter interrupts a short circuit current when the first electrode assembly and the second electrode assembly are separated to open the vacuum interrupter.

29. The method of claim 26, wherein:

the first electrode assembly is a fixed electrode assembly and comprises:

a first coil comprising one or more arcuate arms, and a first contact plate that is positioned between the first coil and the second electrode assembly; and the second electrode assembly is a movable electrode assembly and comprises:

a second coil comprising one or more arcuate arms, and a second contact plate that is positioned between the second coil and the first electrode assembly.

30. The method of claim 26, further operating a drive assembly to switch the circuit breaker from a closed configuration to an open configuration by:

interrupting the first conductive path by separating the tulip contact from the stationary contact and moving the tulip contact to a distance that is at least a length of the vacuum interrupter away from the stationary contact; and after the tulip contact separates from the stationary contact, interrupting the second conductive path by separating the first electrode assembly of the vacuum interrupter from the second electrode assembly of the vacuum interrupter.

31. The method of claim 26, further comprising:

operating a first drive assembly to interrupt the first conductive path by separating the tulip contact from the stationary contact and moving the tulip contact to a distance that is at least a length of the vacuum interrupter away from the stationary contact; and operating a second drive assembly to, after the tulip contact reaches the distance, interrupt the second conductive path by separating the first electrode assembly of the vacuum interrupter from the second electrode assembly of the vacuum interrupter.

32. The method of claim 31, wherein the second drive assembly comprises a contact spring between the second electrode assembly and the second terminal.

33. The method of claim 26, wherein a Lorentz force maintains the vacuum interrupter in the closed position during the first period.

* * * * *